US007832586B2

(12) United States Patent
Vovan

(10) Patent No.: US 7,832,586 B2
(45) Date of Patent: Nov. 16, 2010

(54) MULTI-COMPARTMENT CONTAINER SYSTEM

(75) Inventor: Terry Vovan, Rialto, CA (US)

(73) Assignee: PWP Industries, Inc., Vernon, CA (US)

( * ) Notice: Subject to any disclaimer, the term of this patent is extended or adjusted under 35 U.S.C. 154(b) by 663 days.

(21) Appl. No.: 11/311,503

(22) Filed: Dec. 19, 2005

(65) Prior Publication Data

US 2007/0138046 A1 Jun. 21, 2007

(51) Int. Cl.
*B65D 21/02* (2006.01)
*B65D 41/32* (2006.01)

(52) U.S. Cl. ..... 220/23.89; 220/265

(58) Field of Classification Search ..... 220/359.2, 220/359.1, 380, 4.27, 4.26, 4.01, 260, 315, 220/23.89, 23.88, 23.86, 268, 265, 328, 657, 220/656; 206/507, 505, 503, 499, 514, 518
See application file for complete search history.

(56) References Cited

U.S. PATENT DOCUMENTS 3,070,275 A * 12/1962 Bostrom ..... 229/4.5
3,268,106 A * 8/1966 Satz ..... 220/789
3,360,153 A * 12/1967 Wheaton, Jr. ..... 220/4.21
3,412,888 A * 11/1968 Andrews et al. ..... 220/4.21
3,737,093 A * 6/1973 Amberg et al. ..... 206/447
4,042,143 A * 8/1977 Biggins ..... 220/256.1
4,091,953 A * 5/1978 Daenen ..... 220/23.86
4,105,121 A * 8/1978 Mascetti ..... 206/592
4,807,776 A * 2/1989 Cortopassi ..... 220/23.83
4,848,579 A * 7/1989 Barnes et al. ..... 206/508
5,289,938 A * 3/1994 Sanchez ..... 220/789
5,311,990 A * 5/1994 Kalinski ..... 206/370
5,423,449 A * 6/1995 Gordon et al. ..... 220/23.89
2004/0118848 A1* 6/2004 Marshall ..... 220/266
2005/0051549 A1* 3/2005 Nelson ..... 220/23.83
2006/0261065 A1* 11/2006 Claypool et al. ..... 220/212

FOREIGN PATENT DOCUMENTS

EP 318226 A2 * 5/1989
EP 1736417 A1 * 12/2006
GB 2218962 A * 11/1989

OTHER PUBLICATIONS

U.S. Appl. No. 11/173,302, Vovan, T.
U.S. Appl. No. 11/166,308, Vovan, T.

* cited by examiner

*Primary Examiner*—Anthony Stashick
*Assistant Examiner*—Robert J Hicks
(74) *Attorney, Agent, or Firm*—Baker Botts L.L.P.

(57) ABSTRACT

A food container system that comprises a tray member that is the primary storage container, a first lid member that is molded to comprise a plurality of recesses of either similar or varying sizes to house various foodstuffs, and optionally a third lid member. When assembled, the foodstuff in the first lid member may be retained by a foil that adheres to the mouths of the recesses or the optional third lid member which may be formed to snugly fit over the recesses of the first lid member. The foodstuffs may be mixed in any combination desired. Embodiments of the invention will include for the tray member that may be releaseably attached to either the first or second lid member via a snap-fit grip mechanism; additionally, the first and second lid members may be releaseably attached to each other in a similar manner. The utility of the container system is magnified through the multi-compartmentalized lid member.

3 Claims, 11 Drawing Sheets

MULTI-COMPARTMENT CONTAINER SYSTEM

FIELD OF THE INVENTION

The present invention relates to container system configurations for foodstuff. More particularly, the invention relates to a multi-compartment food packaging containment system that includes a large base tray compartment and a lid member comprising of a plurality of smaller compartments that hold a variety of foodstuffs that may be combined together in any desired apportionment for consumption purposes. The container system preferably includes tamper-resistant features, as well as tamper-evident features that visually evidence unauthorized ingress if interfered either inadvertently or with the intent to cause harm.

BACKGROUND OF THE INVENTION

Retail markets have utilized rigid and flexible plastic containers to protect and display both perishable and fragile food items such as sandwiches, salads and bakery items. These traditional roles of plastic packaging are now the minimum expected standards, and the requirements placed on plastic food packaging continue to expand as increasing demands are placed upon it. Presentation, brand presence, consumer desires, added value to enhance commercial competitiveness, differentiation, imagery and psychology has resulted in the design and application of plastic packaging becoming more challenging. Convenience and versatility continue to shape the future of packaging, with consumers gravitating toward packaged convenience items that minimize the impact on their behavior. This has forced packaging manufacturers to include social and environmental considerations into their development process. The provision of multiple compartments in a variety of shapes and utilities in rigid plastic containers has been one such direction that packaging manufacturers have been pursuing.

Rigid plastic food containers are typically manufactured from Polystyrene, Polypropylene, Polyethylene Terephthalate (PET), Polylactide, Polyvinyl Chloride (PVC), or other rigid polymers. They generally comprise either of two-parts—a tray and lid—or they may be a one-piece construction with a hinge that modifies one portion of the container to act as the tray and the other connected portion to act as a lid. Furthermore, they are available in a variety of shapes and cross-sections—circular, rectangular, square, and elliptical, etc.

A limitation has been the availability of a single rigid plastic packaging system that incorporates a primary recess and a plurality of secondary conveniently sized recesses that can hold a variety of different foodstuffs and which may be combined with the food in the primary recess in portions desired by the consumer. This invention provides for a unique approach that achieves this objective.

SUMMARY OF THE INVENTION

In all embodiments of the invention, the tray and lid members of the container system possess at their edges that are designed to mate with and be releaseably lockable to each other. The releaseably lockable retaining mechanism may include one or more of a variety of snap-fit grip mechanisms.

In one embodiment of the invention, the container system comprises a container with a lid that is molded to form multiple compartments or recesses in it so that a variety of foodstuff can be deposited into them. When the lid is coupled to the tray, the mouths of the recesses comprising the underside or enclosed side of the lid will face the bottom of the tray with the foodstuffs contained in the recesses securely retained in their respective recesses by a membrane that may be plastic film or a metal foil such as aluminum, that is placed over the mouths of all the recesses. The use of such membranes is commonplace and can be found in such food items as frozen microwaveable packaged foods and yogurt cup containers.

In another embodiment of the invention, the lid of the container is molded so that a smaller, second container may be attached to it via a releaseably lockable snap-fit grip, wherein the second container is mounted on the upper side of the lid of the primary aforementioned container. The elements comprising the releaseably lockable snap-fit grip enable a force fit between the lid of the first container and a second condiment container. Therefore, the retail outlet may provide the consumer with prepackaged food product that contains one food type, such as a salad, in the tray of the first container, a second food type, such as a dressing, in the container of the second container, and a variety of alternative foodstuffs, such as bacon bits and grain, in the plurality of recesses comprising the underside of the lid of the first tray. An additional advantage is that all the foodstuff in the container system is clearly displayed for easy viewing by the consumer and the entire integrated package is presented as a single product item for sale.

In another embodiment, the mouths of the recesses of the multi-compartment lid face away from the base of the tray. In this embodiment, the food contents are held in their respective recesses by a second lid that covers the multi-compartmentalized lid and is further secured to the base tray via a releaseably lockable snap-fit grip.

In another embodiment of the invention, a lid of the container system is secured to the tray using tamper-evident tamper-resistant snap-fit grip mechanism. Rigid plastic tamper-evident packaging generally provide visible-to-the-naked-eye indication that a container has been interfered with, that is, it had previously be opened and then re-closed prior to purchase is currently in development, marketed or currently available in the marketplace. This invention is a novel plastic packaging solution that improves significantly on the convenience and therefore marketability of food product.

Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art.

Figure 1:
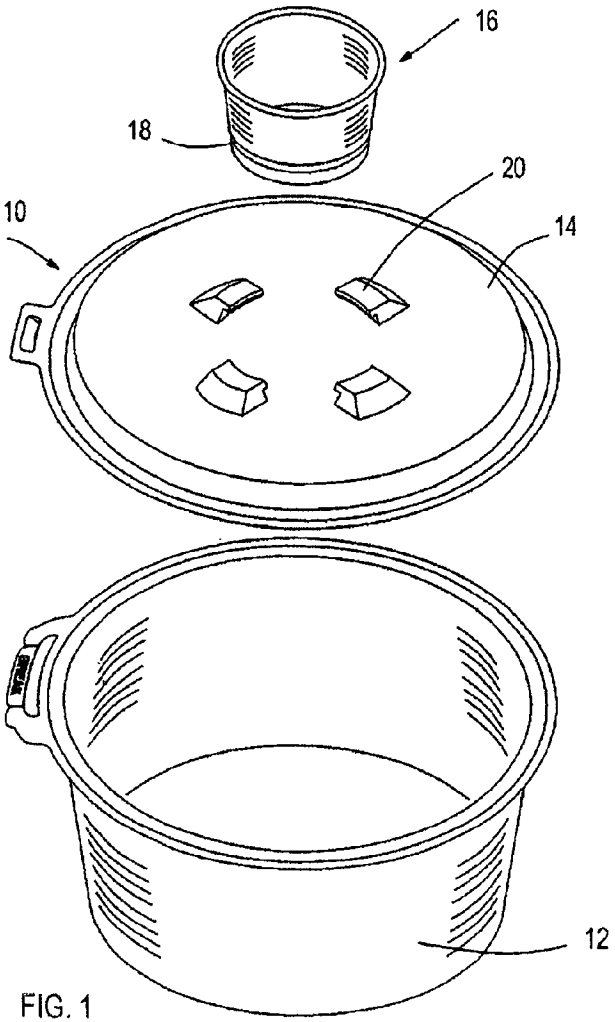
FIG. 1 PRIOR ART
FIG. 1 is an exploded isometric view of a prior art container system configuration.
Figure 3:
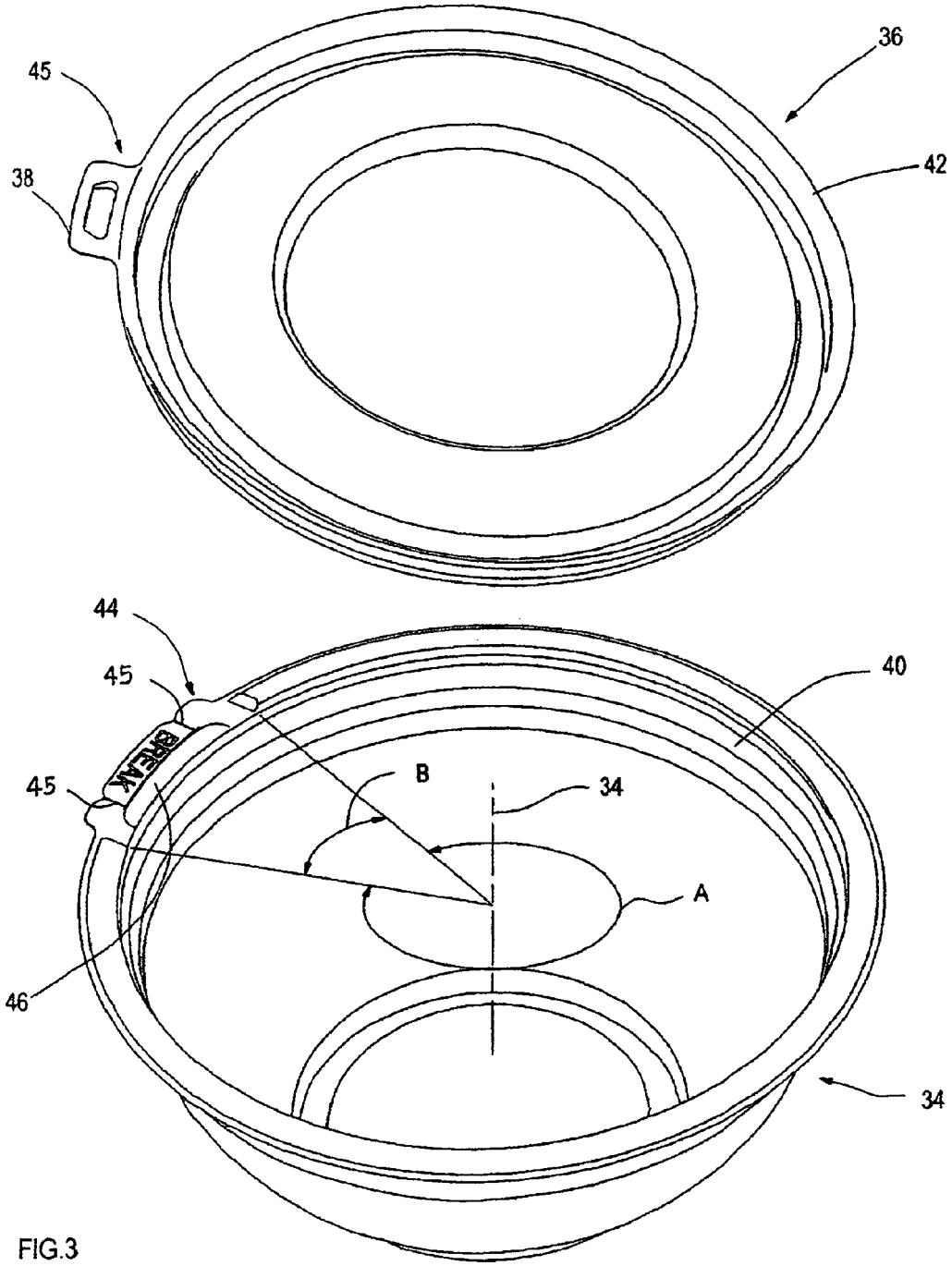
FIG. 3 is an exploded isometric view of the tray member and lid member of applicant's prior tamper-evident container system.
Figure 3B:
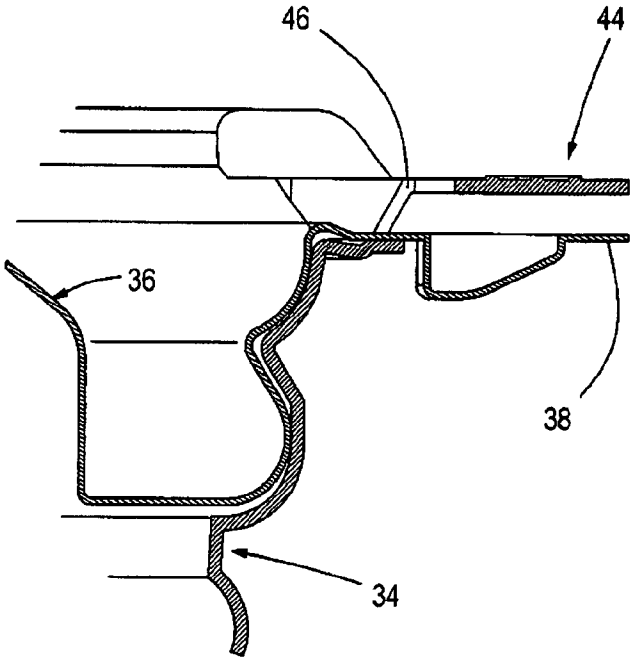
FIG. 3B is a fragmentary sectional view of area V-V of the container system in FIG. 3A.
Figure 3A:
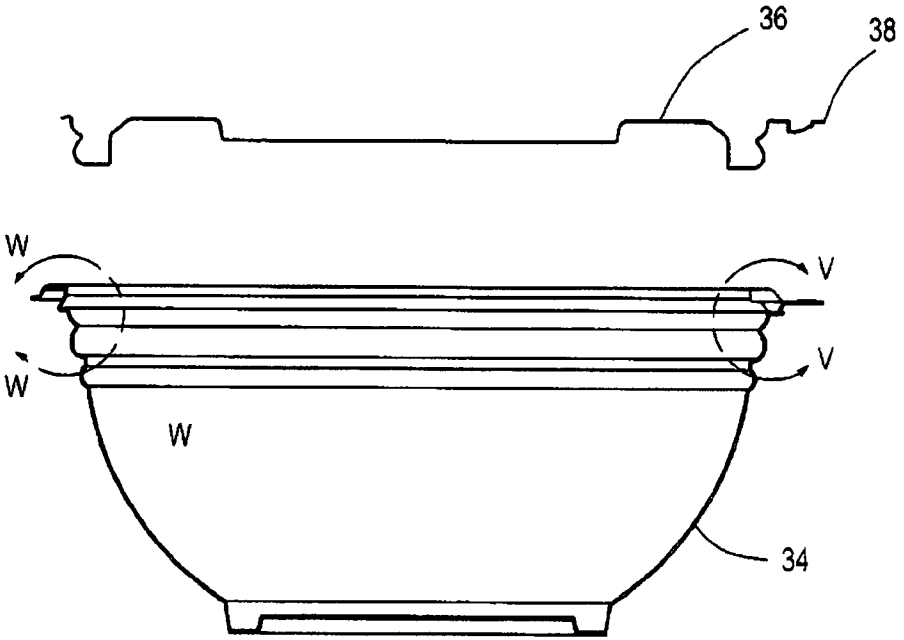
FIG. 3A is a cross-sectional view of the container system in FIG. 3.

FIG. 1 shows an embodiment of a container system that is described in U.S. patent application Ser. No. 11/173,302 filed 30 Jun. 2005, the structure of the invention of which may be employed in combination with the present invention. In FIG. 1, a first container 10 comprising a base tray member 12 and lid member 14, and a second container 16 that is releaseably lockable to the lid member 14 of the first container 10 via a snap-fit grip mechanism. The snap-fit grip mechanism illustrated, in this instance, comprises raised male ribs 20 in the lid member 14 of the first container 10 that mate with a complementary female annular ring groove 18 of the second container 16 to thereby form an interference fit.

Figure 2:
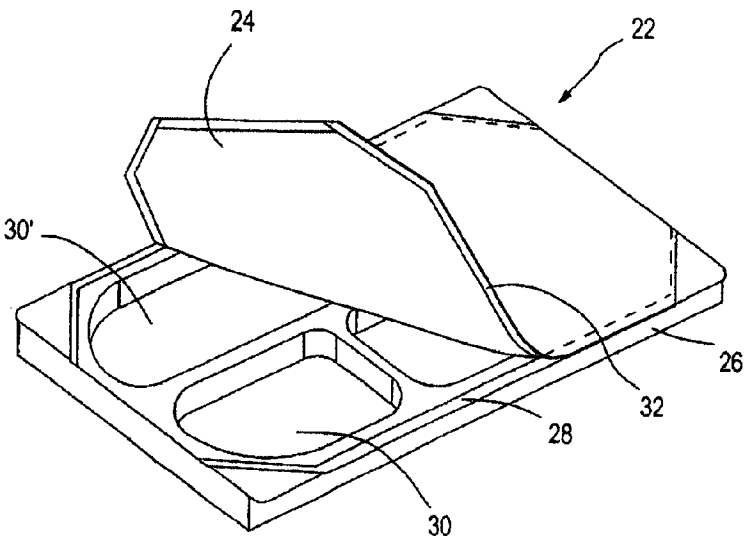
FIG. 2 PRIOR ART
FIG. 2 is a schematic diagram of a prior art multi-compartmentalized tray.

Similarly, FIG. 2 is an illustration of an embodiment of the invention claimed in U.S. Pat. No. 5,423,449, and which may be employed in combination with the present invention. FIG. 2 depicts a food tray container system 22 that comprises a tray member 26 comprising a plurality of recesses 30, 30', and a flexible lid member 24 that is affixed to the tray member 26 by adhesive at mating faces 28 and 32.

FIGS. 3, 3A, 3B and 3C show a bowl-shaped container system embodiment of the invention claimed in U.S. patent application Ser. No. 11/166,308 filed 24 Jun. 2005. A tray member 34 and a lid member 36 that can be closed onto the tray member, as well as the snap-fit grip mechanism that enables the releaseably lockable tamper-resistant, tamper-evident feature and lift tab 38 are shown. The tray member 34 has a trapping 40 that receives a trapping section 42 of the lid member 36 and thereafter resists lid member removal. The tray member 34 further has a pull-open portion 44 with a horizontally open slot 46 that receives the lift tab 38 of a pull-open portion 45 of the lid member 36. Access to contents of the tray member 34 generally requires tearing the pull-open section 44 along one of two tear lines 45 (FIG. 3) to lift tab 38. Such tearing makes it evident that the container system has been opened, and discourages unauthorized opening. It is possible to open the container without tearing at 45, but it is difficult to do so. If a film or foil 60 (FIG. 6) covers the tray and does not restick to the tray when peeled, then this makes it extremely difficult for someone to open the container to taste food in the tray, without making it evident that the container has been opened.

The disclosures of U.S. patent application Ser. Nos. 11/173,302, 11/166,308 and U.S. Pat. No. 5,423,449 are incorporated herein by reference.

Figure 4:
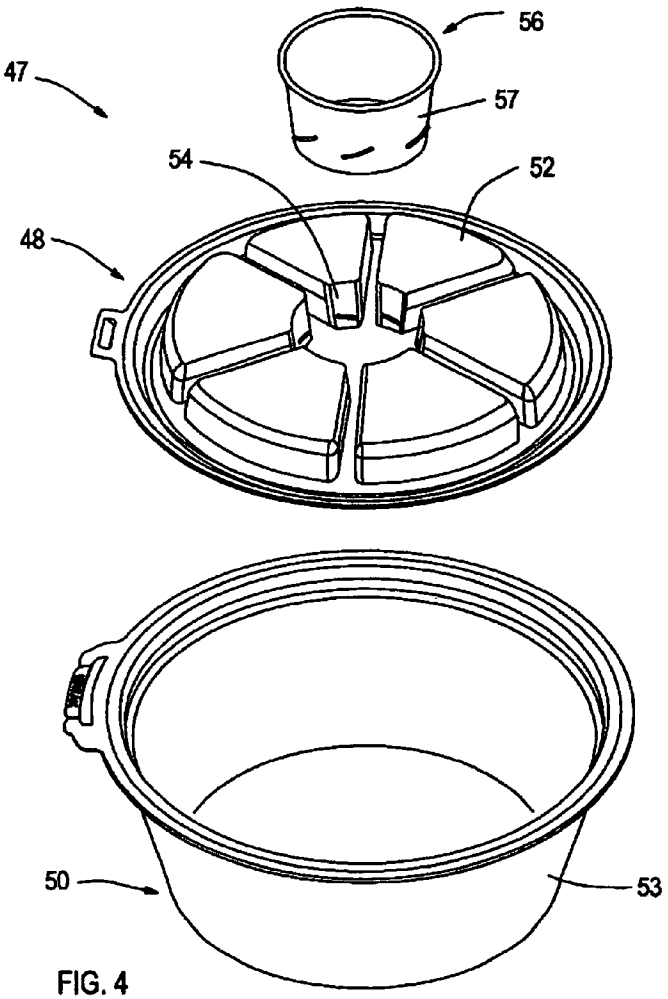
FIG. 4 is a perspective view showing a multi-compartmentalized container system according to the present invention.
Figure 3C:
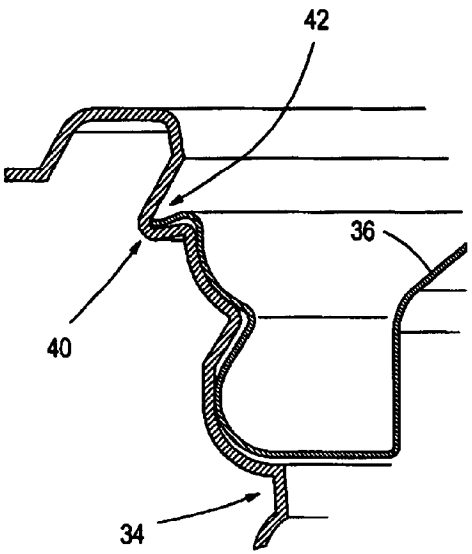
FIG. 3C is a fragmentary sectional view of area W-W of the container system in FIG. 3A.

Referring now to the drawings and in particular to FIG. 4, there is shown a rigid polymer plastic construct food container system 47 according to the present invention. The food container system includes a first container assembly 50 that includes a tray member 53 which forms the primary recess into which foodstuff is placed. The tray member 53 of the first container assembly 50 can be molded, through known thermoforming manufacturing means, from a single sheetline of polymer material work piece into a predetermined shape and thickness as required by the specific specifications. The tray member 53 of the first container 50 may also be formed, through known thermoforming manufacturing means, into a curvilinear geometry to thereby provide the end user with a variety of polygonal shapes. The first container assembly 50 also includes a lid member 52 which has a geometry that permits even mating with the tray member 50 at their peripheral edge. The container system 47 includes a second, smaller container 56 that contains a different food item and is further releaseably fastened on the lid member 52 of the first container assembly using a snap-fit grip. It is anticipated that greater convenience is achieved and that the food packager and retailer's end user client, the consumer, will be able to select such food combination product more easily and readily. In the embodiment shown, the second container 56 may be releaseably lockable to the lid member 52 of the first container assembly via snap-fit grips. The tray 57 of the second container assembly 56 may be made, through known manufacturing means, from a single work piece into a predetermined shape and thickness as required by the specific design specifications, and may further be made from material that are dissimilar from the material used to make the first container assembly.

Figure 6:
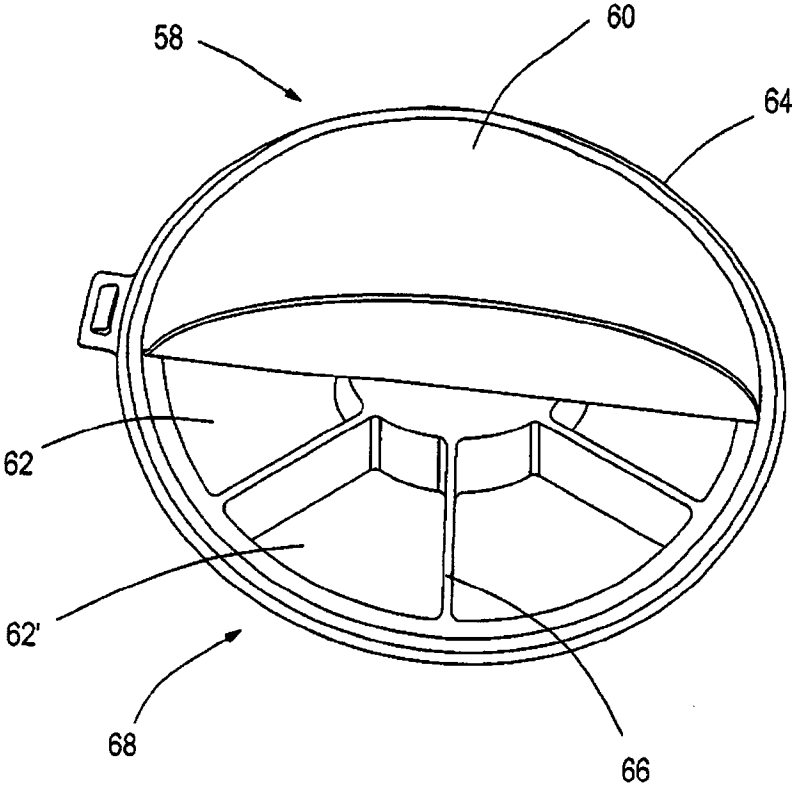
FIG. 6 is a perspective view of the underside of the lid element of the multi-compartmentalized container system in FIG. 4 showing the lid recesses comprising the lid, as well as the film or foil cover.
Figure 5:
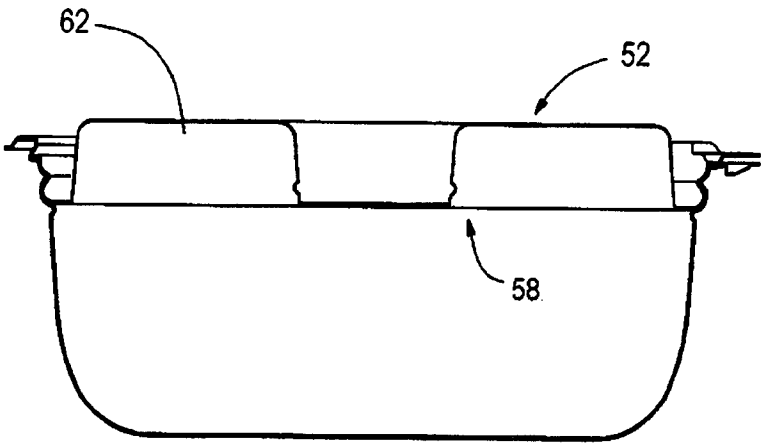
FIG. 5 is a cross-sectional view of the embodiment of the invention in FIG. 4.

Turning now to FIGS. 5 and 6, it is shown that the underside 58 of the lid member 52 comprises a plurality of recesses 62, 62', the mouths of which face toward the base of the tray member 52. Disposed over the face of the underside 58 of the lid member 52 is a film or foil 60 that acts to retain the variety of foodstuffs that are contained in the various recesses 62, 62' comprising the underside 58 of the lid member 52. Retention of the film or foil 60 to the lid member is generally achieved through an adhesive that bonds the film or foil to the lid periphery 64, as well as the ridges 66 of the mouths of the recesses 62, 62'. Access into the recesses 62, 62' is made by peeling off the film or foil 60 as shown.

Figure 8:
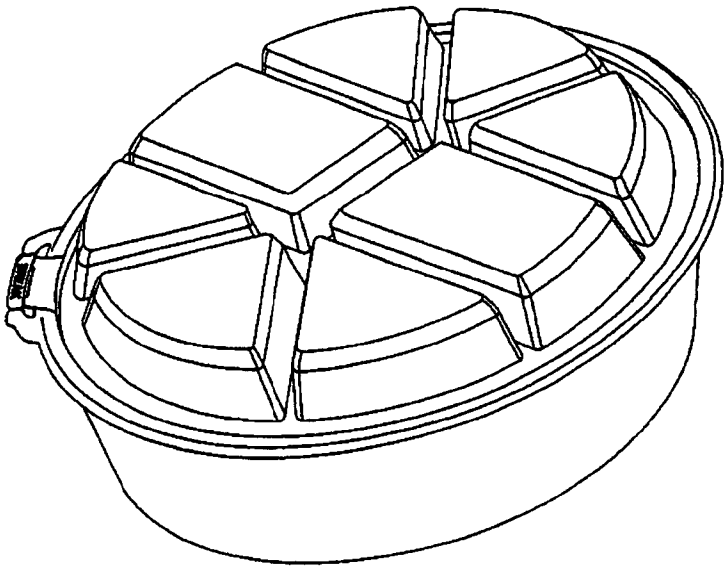
FIG. 8 is a perspective view of another embodiment of the invention.
Figure 7:
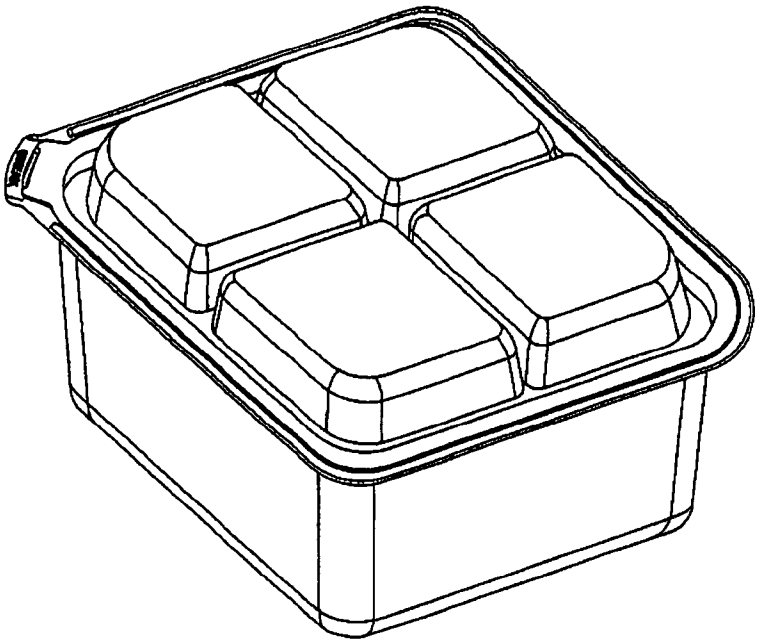
FIG. 7 is a perspective view of another embodiment of the invention.
Figure 9:
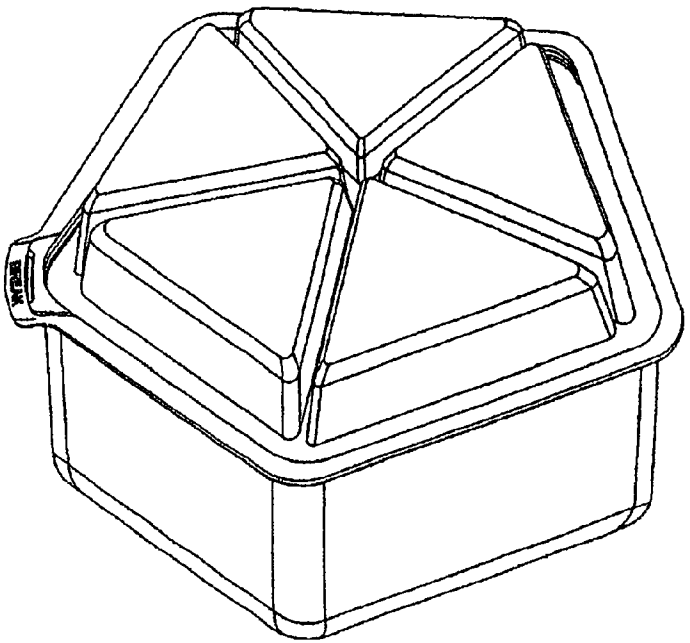
FIG. 9 is a perspective view of another embodiment of the invention.

FIGS. 7, 8 and 9 depict different configurations embodiments of the invention.

Figure 10:
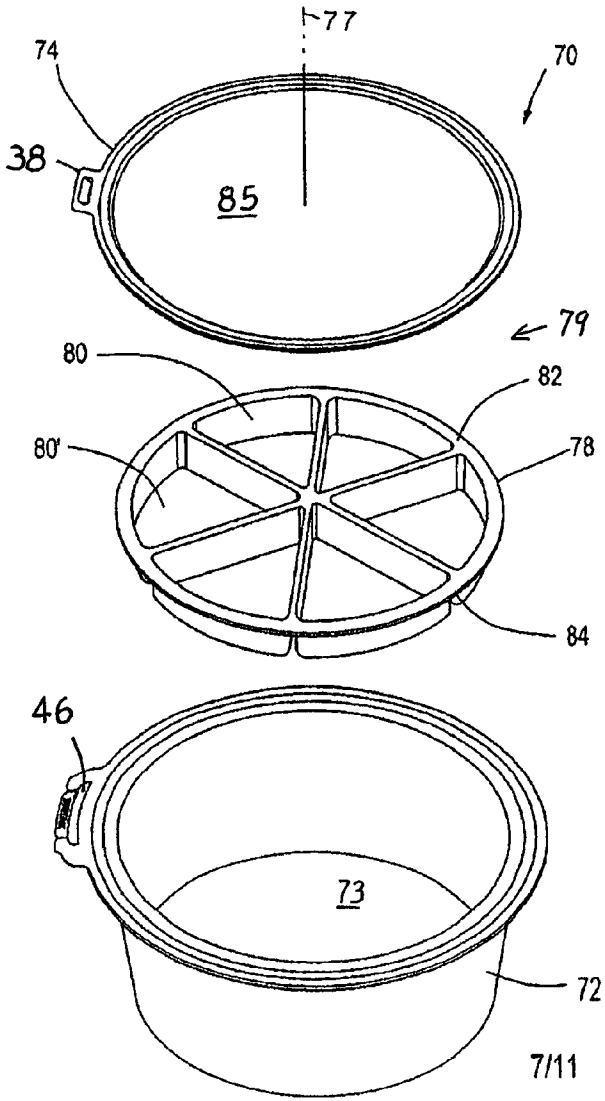
FIG. 10 is an exploded perspective view of another embodiment of the invention.
Figure 11:
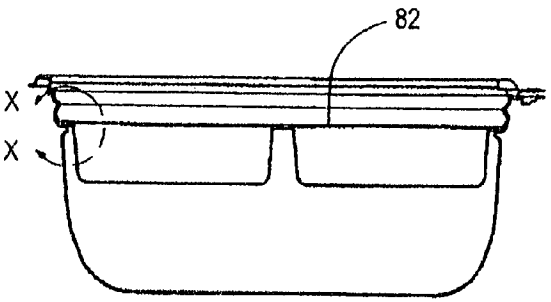
FIG. 11 is a cross-sectional view of the container system illustrated of FIG. 10.
Figure 12:
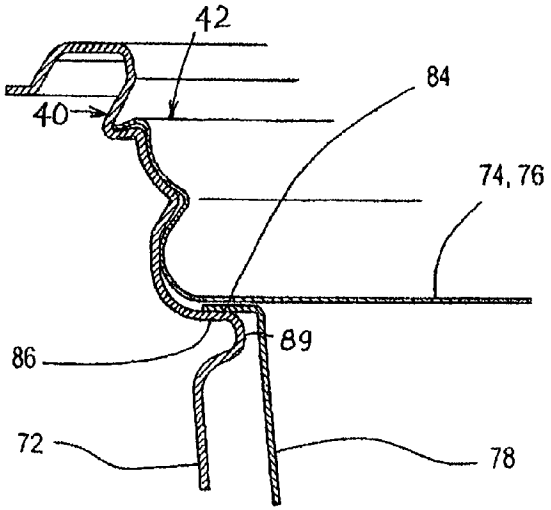
FIG. 12 is an enlarged fragmentary sectional view of area X-X showing the mating of the tray, lid and intermediate multi-compartmentalized lid elements.

In FIGS. 10, 11 and 12, there is shown a container system 70 according to the present invention that comprises a tray member or base 72, a top lid member or top member lid 74 which generally has a planar surface and a geometry that permits even mating with the base 72 at their peripheral edge, and a multi-compartmentalized intermediate lid member or intermediate tray 78. The tray is suspended between the base 72 and the lid 74 and they are all centered on a vertical axis 77. In this embodiment of the invention, the multi-compartmentalized intermediate tray 78 comprises a plurality of recesses 80, 80' that are formed below the planar surface 82 of the intermediate tray, and into which a variety of foodstuffs may be placed. The foodstuffs are retained in their respective recesses 80, 80' by the lid 74. As with prior embodiments, retention of the lid 74 to the base 72 is preferably achieved via any number of tamper evident tamper-resistant sealing mechanisms such as that illustrated in FIG. 3. FIGS. 11 and 12 illustrate the placement plane of the edge circumference, or radially outward flange 84 of the intermediate tray 78 onto the ledge circumference or base ledge 86 of the base 72 which lies at the bottom of the base trapping portion 40. It can be seen from FIGS. 10 and 12 that the outward flange 84 is flat as seen in a sectional view taken perpendicular to the axis 77. FIG. 12 further illustrates that the manner in which the base 74 securely retains the intermediate tray 78 to the lid 72 is by means of a tamper-resistant, tamper-evident snap-fit grip mechanism that forms a snap fit grip which positions a primarily horizontal bottom 76 of the lid adjacent to the base ledge 86. There is also shown the lid 74 placement onto the mouths of the recesses 80, 80' in the intermediate tray 78 to ensure that the content of the recesses are held in their respective compartments. It can be seen that the height of the intermediate lid member (78) is less than half the height of the tray member (72). It also can be seen in FIG. 10 that the top lid member (74) is flat at its top (85) that extends across the entire width of the intermediate lid member (78) to form an attractive combination (79).

By trapping the tray outer flange 84 (FIG. 12) between the lid bottom 76 and the base ledge 86 (which lies at the bottom of the base trapping portion 40), application reduces or eliminates rattling of the tray 78 when the container is carried or otherwise moved, and saves space in the container. It can be seen in FIG. 12 that the tray forms a loop 89 immediately below the tray outward flange and that the tray outward flange 84 lies closely between the loop 89 and the bottom 76 of the lid.

Figure 13:
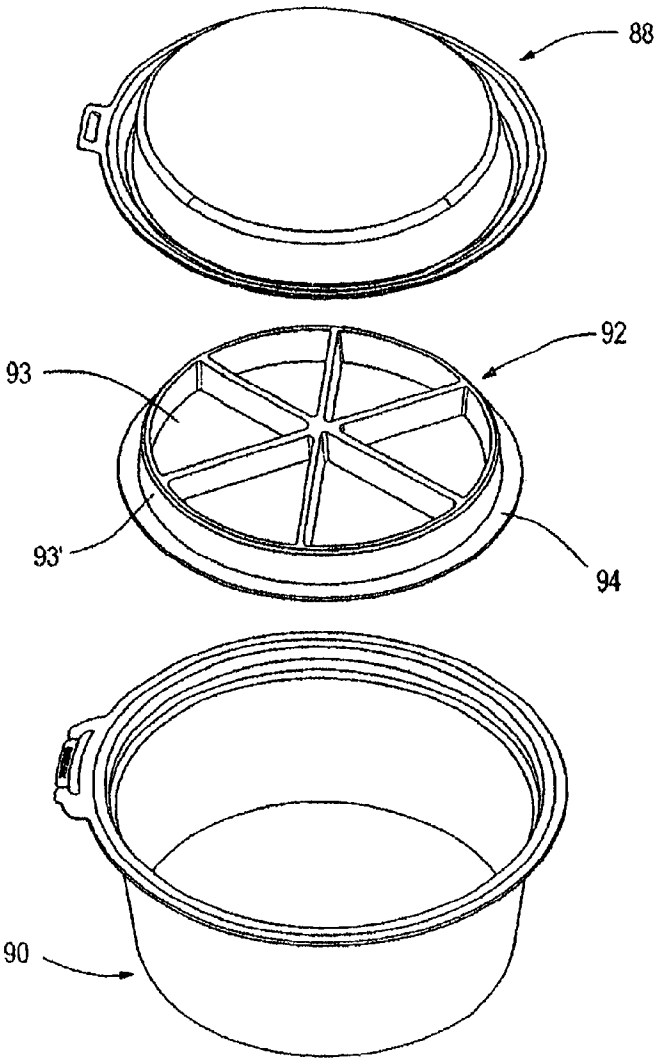
FIG. 13 is a perspective view of another embodiment of the invention.
Figure 14:
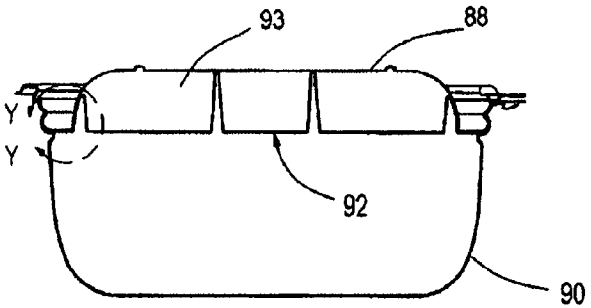
FIG. 14 is a cross-sectional view of the embodiment of the invention depicted in FIG. 12.
Figure 15:
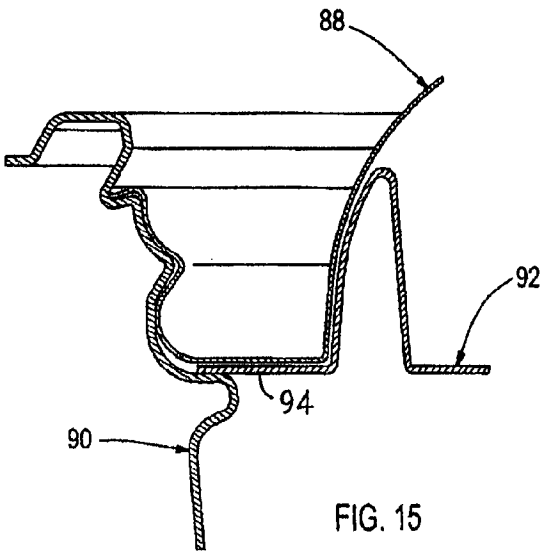
FIG. 15 is an enlarged fragmentary sectional view of area Y-Y of the container system in FIG. 14.

Similarly, in FIGS. 13, 14 and 15 illustrate a container system that includes a top lid member or lid 88 that generally has a planar surface and peripheral edge designed to mate with the peripheral edge of the base 90 in such a manner as to form a tamper-evident, tamper-resistant seal. In this instance, however, the intermediate lid member or tray 92 that is suspended between the lid 88 and base 90 is formed with a plurality of recesses 93, 93' that is configured above the outward flange 94 of the tray 92. In FIG. 12 the tray outward flange 84 lies at the top of the tray while in FIG. 15 the outward flange 94 lies at the bottom of the tray 92. A tray flange 78 (FIG. 10) at the bottom of the tray results in the tray lying in the top of the base cavity 73, and allows for a container of smaller overall height where the tray is not completely filled with salad or other food. A tray flange 94 (FIG. 13) at the bottom of the tray allows food in the tray to be more easily seen through the lid 88 with raised center.

Figure 16:
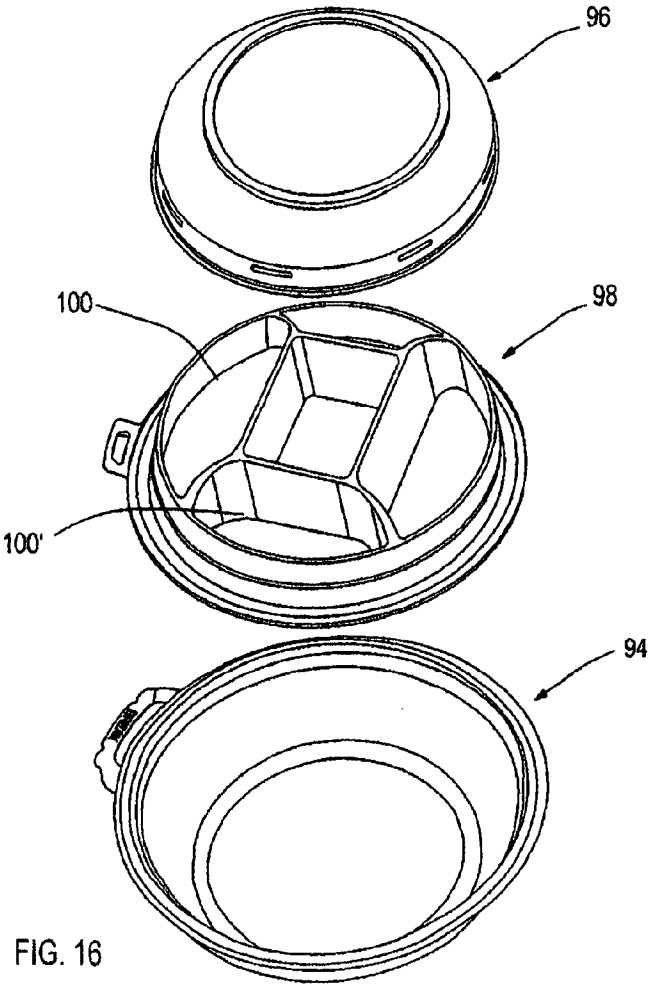
FIG. 16 is an exploded perspective view of another embodiment of the invention.
Figure 17:
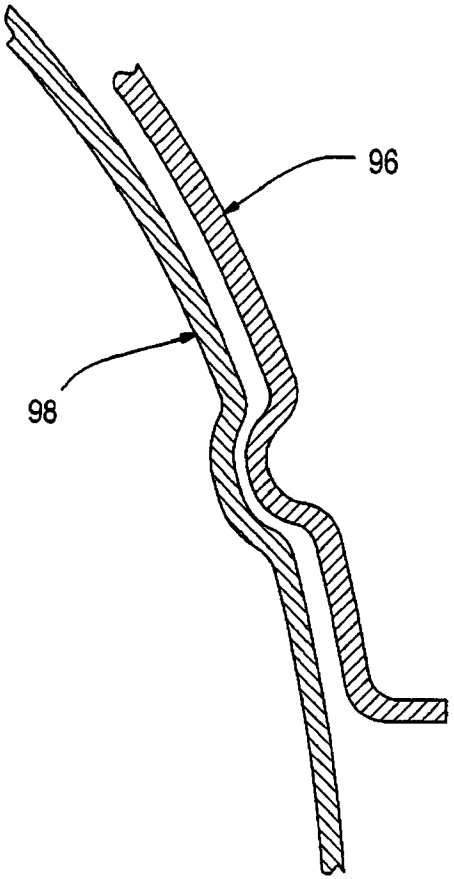
FIG. 17 is an enlarged fragmentary sectional view of the snap-fit grip mechanism of the top lid member and intermediate lid member.

FIG. 16 illustrates another embodiment of the invention and includes an intermediate lid member 98 that comprises a plurality of recesses 100, 100' into which foodstuffs may be placed and which further incorporates an edge geometry that permits mating with a complementary mating edge of the tray member 94 to form a tamper-evident, tamper-resistant seal. As with the embodiments illustrated in FIGS. 10 and 13, the contents are retained in their respective recesses by a top lid member 96. In this instance, however, the lid member 96 is releaseably attached to the intermediate lid member 98 as opposed to the tray member 94 via a snap-fit grip mechanism such as that illustrated in FIG. 17.

Figure 18:
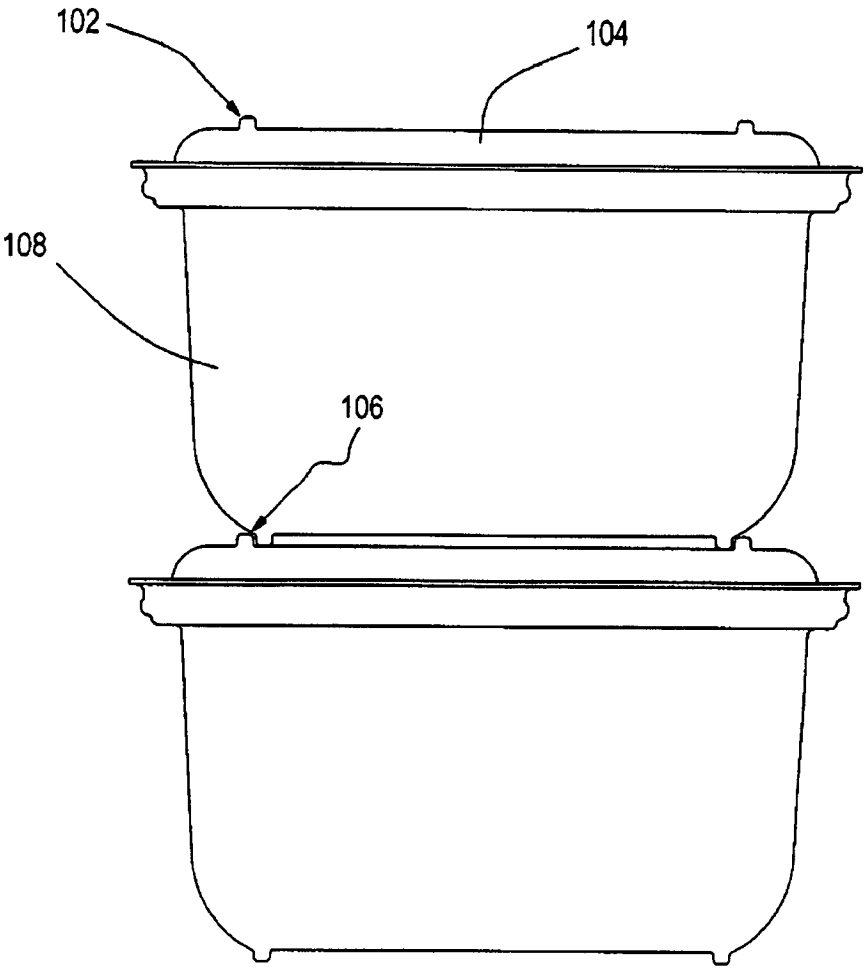
FIG. 18 is side cross-section view of the container system illustrating how the food containers may be stacked.

FIG. 18 illustrates one manner in which stacking of the container system described herein may be achieved. Discrete or continuous male ribs 102 in the lid member 104 are formed so that they slot into and make a mechanical fit with complementary male ribs 106 in the tray member 108. The slotably connected lid and tray members have thus a mechanical fit that restrict lateral movement of the container system when they are stacked. Male ribs have been used to illustrate this application; however, female grooves may be substituted for male ribs to achieve the same result.

Figure 20:
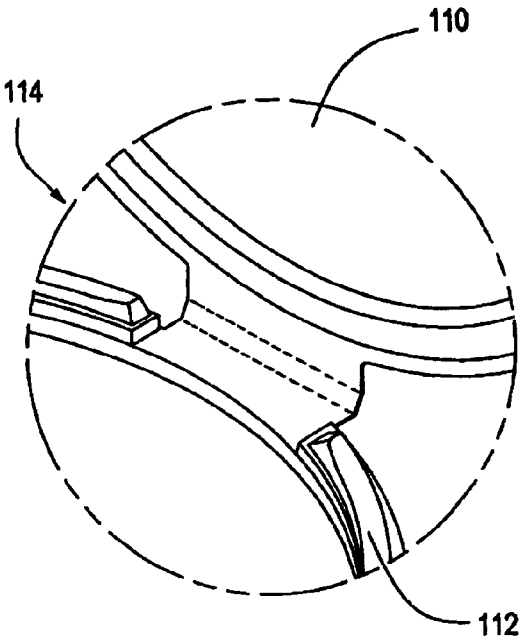
FIG. 20 is an exploded view of the hinge mechanism in FIG. 19.
Figure 19:
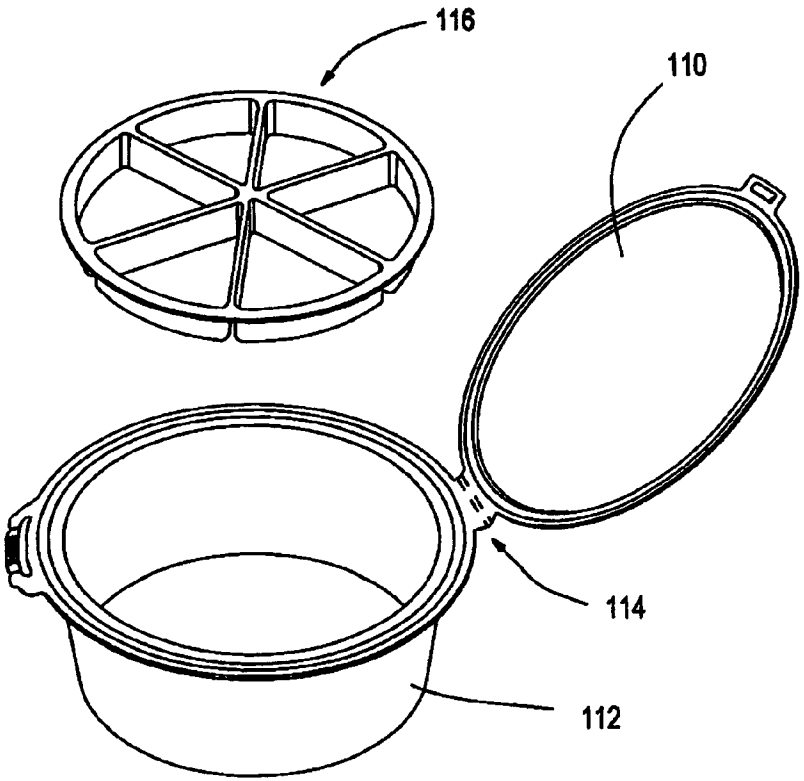
FIG. 19 is an embodiment of the invention showing a hingeably connected lid and tray members.

Finally, in FIGS. 19 and 20, therein the shown an embodiment of the invention wherein the top lid member 110 and tray member 112 are hingeably connected to each other by a hinge 114. In this instance, the top lid and tray members are generally produced as a single structure. As in the embodiment of the invention depicted in FIG. 10, the intermediate lid member 116 is suspended between the tray member 112 and the lid member 110.

Plastic packaging sealing mechanisms generally include snap-fit grips that effectively provide a leak-proof seal that allows the consumer to open, close and releaseably lock the container system multiple times. Some of the advantages of this aspect of the invention are that food freshness can be extended then would otherwise occur without sealing and spillage of the food content is prevented.

Although particular embodiments of the invention have been described in detail for purposes of illustration, various modifications and enhancements may be made without departing from the spirit and scope of the invention. Accordingly, the invention is not to be limited except as by the appended claims.

I claim:

1. A container system that includes a base with a cavity for holding food, a lid for covering said base, and an intermediate tray that lies between said base and lid, wherein:

said base has a base trapping portion with a base ledge having a flat horizontal portion at the bottom of said base trapping portion, and said lid has a trapping section that is received in the base trapping portion and that lies directly against the base trapping portion to resist lid lifting, with the lid having a flat primarily horizontal bottom that lies adjacent to said base ledge;

said intermediate tray has a primarily flat outward flange that is trapped between said primarily flat horizontal bottom of said lid and said flat base ledge.

2. The container system described in claim 1, wherein:

said lid is primarily flat;

said base is formed into a loop that lies immediately below said intermediate tray outward flange, with said tray outward flange lying closely between the loop and a bottom of the lid, said loop having an upper loop side that forms said base ledge and a lower loop side.

3. A container system described in claim 1, wherein:

said base has an upper end with a periphery that forms a tab-receiving slot that opens at least partially horizontally;

said lid has a lift tab at its periphery that projects outward through said tab receiving slot, with walls of said tab-receiving slot being breakable and requiring such breakage to enable said lift tab to be lifted to lift said lid while providing evidence of container opening.

* * * * *